US006221210B1

(12) United States Patent
Kurihara et al.

(10) Patent No.: US 6,221,210 B1
(45) Date of Patent: Apr. 24, 2001

(54) TRANSFER PAPER FOR ELECTROPHOTOGRAPHY AND A METHOD FOR PRODUCING THEREOF

(75) Inventors: Tsutomu Kurihara; Hiroyoshi Hosomura; Katsumi Harada, all of Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 08/441,948

(22) Filed: May 16, 1995

Related U.S. Application Data

(63) Continuation of application No. 08/070,884, filed on Jun. 3, 1993, now abandoned.

(30) Foreign Application Priority Data

Jun. 4, 1992 (JP) ..... 4-168282

(51) Int. Cl.[7] ..... D21H 27/14

(52) U.S. Cl. ..... 162/100; 162/197; 162/203; 162/205; 162/206; 162/212

(58) Field of Search ..... 162/197, 212, 162/203, 205, 206, 207, 135

(56) References Cited

FOREIGN PATENT DOCUMENTS

| | | | | |
|---|---|---|---|---|
| 512682 | * | 5/1955 | (CA) | 162/197 |
| 2830046 | * | 3/1979 | (DE) | 162/203 |
| 42-16341 | * | 9/1967 | (JP) | 162/197 |
| 48-96801 | | 12/1973 | (JP) . | |
| 51-29505 | * | 3/1976 | (JP) | 162/203 |
| 51-102107 | | 9/1976 | (JP) . | |
| 54-96107 | | 7/1979 | (JP) . | |
| 57-204057 | | 12/1982 | (JP) . | |
| 3-236062 | | 10/1991 | (JP) . | |
| 3-243953 | | 10/1991 | (JP) . | |
| 3-287894 | | 12/1991 | (JP) . | |
| 3-287895 | | 12/1991 | (JP) . | |
| 4-18188 | | 1/1992 | (JP) . | |
| 4-5662 | | 1/1992 | (JP) . | |

OTHER PUBLICATIONS

Casey, *Pulp and Paper*, 3rd ed., vol. II (1980) p 1039–1043.*
"Curl Control—Panel Discussion," *TAPPI*, vol. 47 No. 7 (Jul. 1964) p 168A–170A.*
Casey, *Pulp and Paper*, vol. III, 3rd ed. (1981) p 1774–1777.*

* cited by examiner

*Primary Examiner*—Peter Chin
(74) *Attorney, Agent, or Firm*—Finnegan, Henderson, Farabow, Garrett & Dunner, L.L.P.

(57) ABSTRACT

The present invention relates to transfer paper in electrophotography that shrinks by no more than 0.45% in a direction crossing a flow in making paper process and which has a two sideness shrinkage difference in a crossing direction ranging 0.02 to −0.02%. The present invention also relates a process for producing electrophotographic transfer paper comprising the steps of feeding pulp suspension liquid onto at least one wire to form a paper layer in making paper process, in which a ratio between feeding speed of the pulp suspension liquid and moving speed of wire is controlled to cause a propagating velocity ratio of longitudinal waves of a produced transfer paper in the range from 1.1 to 1.5.

4 Claims, 6 Drawing Sheets

TRANSFER PAPER FOR ELECTROPHOTOGRAPHY AND A METHOD FOR PRODUCING THEREOF

This application is a continuation of application Ser. No. 08/070,884, filed Jun. 3, 1993, now abandoned.

BACKGROUND OF THE INVENTION

The present invention relates to transfer paper that is designed to experience a smaller amount of curl upon heat fixing in indirect electrostatic copiers, indirect electrostatic printers and the like (the curl is hereunder referred to as "post fuser curl").

To thermally fuse a toner image in paper on a copier, a printer and the like, it is a common practice to apply heat to one side of the paper. In this case, moisture is removed unevenly from two sideness of the paper and this causes the paper to curl, leading to troubles such as a paper jam and incomplete or inefficient accommodation of paper in the document catching tray or the sorter. If paper absorbs moisture, the paper curls in a particularly great amount on the side opposite the side where copy was made and this increases the chance of the occurrence of troubles. Thus, post fuser curl is an important characteristic that greatly affects the runnability of paper on copiers, printers, etc.

Recent models of medium- and high-speed copiers and printers come in smaller size and yet they feature versatile capabilities such as automatic two-sided copying, multiple color copying and automatic bookbinding. As a result, the complexity of their mechanism has increased and it is required to further reduce the post fuser curl in order to accomplish consistent operations and paper accommodation in the sorter. Take, for example, a machine model that has such paper transport paths that the relationship between the direction in which the copy paper is set in a paper tray and the side of paper where fuser fixing is to be performed varies depending upon which tray is used; with this model, differences will occur on the side of paper where fusing is done and the shape and size of the post fuser curl will vary with the side of paper where copy was made, which can potentially lead to a paper jam or incomplete paper accommodation. In addition, as the frequency of two-sided copying increases, a machine that can perform satisfactorily in one-sided copying operations may occasionally fail due to such troubles as a paper jam and incomplete paper accommodation.

As a result of these changes in the circumstances under which transfer paper is used, the demand for improving quality of paper has increased year by year and there exists particularly strong need for electrophotographic paper that has a satisfactory curl characteristic regarding moisture absorption and which experiences only a small difference in curl between two sideness.

Various methods have heretofore been proposed with a view to solving the problems that occur in electrophotographic paper on account of post fuser curl. For example, Japanese Patent Examined Publication Nos. Sho. 48-96801, 51-102107 and 54-96107 proposed the incorporation of inorganic or synthetic fibers for the purpose of improving the resistance to post fuser curl. However, when inorganic fibers were incorporated, the strength of paper stock drops so markedly that there occurs problems in terms of papermaking operations and the quality of the paper produced. When synthetic fibers were incorporated, the heat resistance of paper stock decrease, causing other problems such as deformation and shrinkage during fuser fixed. Furthermore, both methods had the disadvantage of a significant increase in cost since they used fibers that are more expensive than wood pulp.

Japanese Laid-Open Patent Application Nos. Hei. 3-287894, 3-287895 and 4-18188 disclosed methods that were intended to improve the anti-curl property of mechanical pulp containing paper by controlling its equilibrium moisture and other characteristics. Japanese Laid-Open Patent Application No. Sho. 57-204057 disclosed a method for improving the anti-curl property by increasing the content of fillers but this approach had problems such as lower stiffness and the formation of paper dust in an increased amount. According to the proposals made in Japanese Laid-Open Patent Application Nos. Hei. 3-236062, 3-243953 and 4-5662, it was attempted to solve the problem of curl by controlling the following three parameters respectively: the difference in shrinkage between two sideness of paper; the residual curvature of paper, and the length of fibers in pulp. However, none of these patents disclosed means that will be effective in eliminating the problem of not only the curl upon moisture absorption but also the difference in curl between two sideness of paper.

SUMMARY OF THE INVENTION

The present invention has been accomplished under these circumstances and has as an object having transfer paper for electrophotography (which is hereunder referred to simply as "transfer paper") that will experience a smaller amount of post fuser curl upon moisture absorption, which has a smaller difference in curl between its two sideness, and which is more applied for electrophotography than the conventional version, thereby assuring consistent copying operations and satisfactory paper accommodation in sorters even if it is used under various copying conditions on recent models of medium- to high-speed copiers or printers which are becoming compact and versatile in their capabilities.

The aforementioned object of the present invention can be attained by transfer paper that shrinks by no more than 0.45% in cross(transverse) direction and which has a range from 0.02 to −0.02% of a shrinkage difference in the cross direction between two sideness thereof.

In a preferred embodiment, this transfer paper is such that longitudinal waves of ultrasonic pulses propagate at a velocity ratio in the range from 1.1 to 1.5, that it has been dried under tension to a degree of 0.10% and below, and that the paper layer is formed by performing dehydration from both two sideness of a paper mill. The transfer paper thus produced has higher resistance to post fuser curl than the prior art versions irrespective of which side of the paper is subjected to copying.

The present inventors found that paper accommodation in sorters was excellent when the post fuser curl was within a specified range as shown in FIG. 1. The inventors then made investigation about the improvement in post fuser curl in terms of paper shrinkage in the cross direction. As FIG. 2 shows, it was found that when the shrinkage of paper was 0.45% and below, the post fuser curl was reduced and paper accommodation in sorter became excellent even when moisture absorption occurred.

The present inventors also investigated the relationship between the post fuser curl and the difference of shrinkage in the cross direction between the two sideness of paper. The results are shown in FIG. 3; given a high value of shrinkage rate on the wire side of the paper, extensive curl occurred on an image side when it faced the wire side whereas extensive curl occurred on the surface opposite the image side when the latter faced a felt side. The result was converse when the felt side of the paper had a high value of shrinkage rate. It was also found that by insuring that the difference in shrinkage in the cross direction between both sides of the paper lies within the range from 0.02 to −0.02%, the post fuser curl could be reduced to a very small amount irrespective of whether copy was made on the felt or wire side of the paper and that, therefore, sheets of paper could be stacked consistently in trays or sorters.

As for the prior art transfer paper, it was extremely difficult to reduce the difference in shrinkage between the two sideness of the paper to lie within the range from 0.02 to −0.02%; however, the present inventors found that the range could be attained fairly easily by adjusting the shrinkage of paper in the cross direction to 0.45% and below. It was also found that on account of the synergistic effect of these two characteristics, the deference in curl between the two sideness of the paper could be markedly reduced even when moisture absorption occurred.

In addition, as FIG. 4 shows, the shrinkage rate of paper was related not only to the longitudinal wave propagation velocity ratio of ultrasonic pulses but also to the degree of drying under tension and as these parameters were reduced, the shrinkage rate of paper decreased. The present inventors found that a shrinkage of 0.45% and below could be achieved when the longitudinal waves of ultrasonic pulses were allowed to propagate at a velocity ratio of 1.1 to 1.5 and when the paper was dried under tension to 0.1% and below.

The inventors also found that the shrinkage difference of from 0.02 to −0.02% between the two sideness of the paper could be attained more easily by forming the paper layer as dehydration was performed from both two sideness of a paper mill under the conditions set forth in preceding paragraphs. The present invention has been accomplished on the basis of this finding.

Details of the present invention are shown below.

The paper making is executed according to flow processes as shown in FIGS. 6(*a*) to 6(*f*).

FIGS. 6(*a*) to 6(*c*) are schematic drawings of paper making processes by means of a Fourdrinier machine. In these figures, there are a stock inlet 11, wire 12, hydro-wheel 13, wire roll 14, felt 15, felt roller 16, dryer roller 17, felt roll 18, felt 19, size press roller 20, calender roller 21, reel 23 and coiling roller 24.

FIGS. 6(*d*) to 6(*f*) are schematic drawings of an embodiment of the invention using paper making of a twin-wire type. In these figures, there are a stock inlet 31, wire 32, wire roller 33, felt 34 and felt roller 35, and corresponding elements having the same reference numbers as in. FIGS. 6(*a*) and 6(*b*).

FIGS. 7(*a*) and 7(*b*) show an embodiment of the invention, representing a dryer section to realize a drying with an appropriate force of constraint. In these figures, there are a wet paper 41, dryer roll 42, felt 43, felt roll 44, suction roll 45, doctor 46 and last press 47.

The making paper is realized to suitably beat raw pulp, to add mixing size agents, fillers, dyes and etc., so as to prepare a pulp suspension liquid.

In a wire section, the pulp suspension liquid is injected to each moving wire 12 and 32 from each stock inlet 11 and 31 (FIGS. 6(*a*) and 6(*d*)). In time, T/Y ratio is variably changed according to a control between an feed jet speed of the pulp suspension liquid and a wire speed. And then, in the wire section, almost water is removed. Since fine fibers and fillers flow out during dehydrating, the dehydration from one side such as the Fourdrinier machine allow to occur the difference between two sideness. Therefore, it is better to use a paper mill dehydrating from two sideness (twin wire type, and the like).

In press section, further dehydration of the wet paper is performed under pressure between felt 15 and felt roller 16.

In dryer section, the wet paper is dried by heat between felt roll 18 and dryer roller 17. In the time, as shown in FIGS. 7(*a*) and 7(*b*), by means of reducing no force time period of constraint to the paper between dryer rolls 42 (that is, a drying process having a short distance between the dryer rolls), it is able to reduce the degree of drying under tension.

Finally, in size press section, surface sizing agent and electronic resistor adjusting agent are coated. And passing through calender section, reel section and shredder section, a paper is produced.

As shown in FIG. 4, since the shrinkage relates to the longitudinal wave propagation velocity ratio and the degree of drying under tension, the shrinkage is able to be reduced by reducing these ratio and degree. There are conditions of raw pulp to eliminate the aimed shrinkage of 0.45% and below by means of only JET/WIRE ratio control in the wire section of making paper process. However, by means of dryer section under force of constraint to the paper, the shrinkage is able to be reduced more easily.

Accordingly, the present inventors found that a shrinkage of 0.45% and below could be achieved without selecting kind of raw pulp in accordance with setting conditions of paper mill so that the longitudinal waves of ultrasonic pulse were allowed to propagate at a velocity ratio of 1.1 to 1.5 and that the paper was dried under tension to 0.1% and below.

Further, the inventors found that the shrinkage difference of from 0.02 to −0.02% between the two sideness of the paper could be attained more easily by forming the paper layer as dehydration was performed from both two sideness of a paper mill under the conditions set forth in preceding paragraphs.

The term "shrinkage rate of paper" as used herein means the change rate in the dimensions of paper that occurs when it is subjected to three cycles of moisture absorption and desorption at 20° C., each cycle consisting of successive exposure to 65% r.h., 25% r.h., 65% r.h. and 90% r.h., followed by final moisture desorption from 65% r.h. to 25% r.h. The "difference in shrinkage" is determined by first stripping the two side faces of paper, then measuring the shrinkage rates of the respective faces, and subtracting the shrinkage of the paper on the felt side from that of the paper on the wire side.

The "degree of drying under tension" means the dimensional change rate from the initial dimensions as measured after final moisture desorption from 65% r.h. to 25% r.h.; the indication of the change is preceded by the positive sign if it is elongation and by the negative sign if it is shrinkage. Whichever the case, dimensional changes from the initial values are measured on a sample 50 mm wide by 100 mm long with an equal ratio exchange shrinkage meter by applying a tension about half the basis weight of the paper. The term "cross(transverse) direction" as used herein means a direction perpendicular to the direction of advance through a paper mill during paper production.

The term "longitudinal wave propagation velocity ratio (T/Y ratio) of ultrasonic wave" as used herein means the value expressed by the following equation:

T/Y ratio=(velocity of propagation of ultrasonic wave in MD)/(velocity of propagation of ultrasonic wave in CD)

where MD stands for "machine direction" which is parallel to the direction of paper path in a paper mill, and CD stands for "cross(transverse) direction" which is perpendicular to the direction of paper path in the paper mill.

The longitudinal wave propagation velocity ratio of ultrasonic wave as defined above can be determined by a method of measurement as illustrated in FIG. 5. A 10-mm long rubber plate 1 containing air bubbles is provided. A sample 2 is placed on top of the rubber plate 1, and a transmitting transducer 3 and a receiving transducer 4 are placed in contact with the sample as they are kept apart by a distance of 150 mm. Longitudinal waves of ultrasonic pulse are sent from a transmitter 5 and received by a receiver 6. The time required for the longitudinal waves emerging from the transmitting transducer to propagate through the sample to be received by the receiving transducer is measured for conversion to the velocity of propagation. For the sample of interest, the velocity of propagation is measured in both machine and cross directions and the ratio of the two velocities is determined. FIG. 5 shows a computing device 7 and a display device 8.

The T/Y ratio can be reduced by either adjusting the JET/WIRE ratio (the ratio of feed jet speed to the wire speed on paper mill) or controlling the tension on paper in the machine direction as it is pressed and the tension on paper in the machine direction as it is dried with a dryer. In case of making paper with a Fourdrinier machine, the difference in shrinkage between the two sideness of paper can be reduced by controlling the paper making speed or the rate of dehydration. The same object can be attained more easily by using a twin wire machine such as an on-top former which forms a paper layer by performing dehydration from both two sideness of the machine.

To reduce the degree of drying under tension, paper that has been pressed (to a water content of 40 to 60%) may be dried with a dryer as it is given in cross direction an appropriate force of constraint that is associated with the T/Y ratio. Since the paper is inhibited from shrinking in the cross direction during drying with a dryer, the shrinkage that occurs after the water content of the paper has changed as a result of drying is significantly smaller than the shrinkage that occurs as a result of "free" drying in which no force of constraint is imparted in the cross direction of paper as it is dried with a dryer.

Various methods may be employed to apply a force of constraint to the paper in its cross direction during drying with a dryer. Among the methods that can be adopted are: constraint under vacuum (Japanese Laid-Open Patent Application Nos. Sho. 61-266693, 58-70794 and 56-501732), constraint by an air blow (Japanese Laid-Open Patent Application Nos. Sho. 61-501461 and 62-62998), constraint of one side of paper by the combination of felt and roll, etc. (Japanese Patent Examined Publication Nos. Sho.60-29800, 60-35477, 52-11786 and 52-11784, and Japanese Laid-Open Patent Application No.61-258094), and constraint by felt and canvass, etc. (Japanese Laid-Open Patent Application Nos. 49-50206 and 51-357038).

The pulp to be used in the present invention may contain virgin chemical pulps (CP including hardwood bleached kraft pulp, softwood bleached kraft pulp, hardwood unbleached kraft pulp, softwood unbleached kraft pulp, hardwood bleached sulfite pulp, softwood bleached sulfite pulp, hardwood unbleached sulfite pulp, softwood unbleached sulfite pulp, and other pulps that are produced by chemical treatment of wood and other fibrous materials) or virgin mechanical pulps (MP including ground-wood pulp, chemicgroundwood pulp, chemimechanical pulp, semi-chemical pulp, and other pulps that are primarily produced by mechanical treatment of wood and other fibrous materials). Also usable are waste paper pulps that are prepared by disintegrating white waste papers including offcut such as binders wastes which occur in binding operations, imperfections that occur in printing presses and other waste stuffs that occur in shredder shops, as well as those pulps prepared by disintegrating and deinking waste papers that originate from woodfree paper, woodfree coated paper, medium-quality paper, medium-quality coated paper, groundwood paper, etc. on which printing has been done by lithography, letter-press, intaglio, electrophotography, thermal process, thermal transfer process, pressure-sensitive recording ink-jet recording or with the aid of carbon paper, and those waste papers and crushed newspapers on which information has been written by means of water- or oil-base inks or other writing devices such as pencils (the second type of waste paper pulps regenerated by disintegration and deinking are hereunder abbreviated as "DIP").

The prior art electrophotographic paper has chiefly used virgin chemical pulps; in contrast, the present invention permits extensive use of mechanical pulps and waste paper pulps which have heretofore been held unsuitable for use in electrophotographic paper.

Fillers that can be used in the transfer paper of the present invention include inorganic fillers and organic fillers. Exemplary inorganic fillers include calcium carbonates such as ground calcium carbonate, precipitated calcium carbonate and chalk, and silicates such as kaolin, calcined clay, pyrophyllite, sericite and talc; exemplary organic fillers are urea resins. If fillers are used, calcium carbonates are preferably incorporated from the viewpoint of maintaining image quality in electrophotography, with the ash content (JIS P 8128) being adjusted to be 8% and below.

Sizing agent to be mixed that can be used in the present invention include rosin-base sizing agent, synthetic sizing agent, petroleum resin-base sizing agent and neutral sizing agent. If necessary, an appropriate sizing agent such as aluminum sulfite or cationic starch may be used in combination with a fiber fixing agent. Desirably, a neutral sizing agent, in particular, an alkenylsuccinic anhydride-base sizing agent may be used from the viewpoint of runnability on electrophotographic copiers, printers, etc. and the keeping quality of printed copies.

Furthermore, the, starting materials are prepared and produced under the conditions that are appropriately controlled to impart adaptability for electrophotography in such aspects as adaptability for copying and runnability.

To prevent the formation of uneven image and to thereby maintain an appropriate copy image density, a conductive agent such as sodium chloride, potassium chloride, styrene/maleic acid copolymer or a quaternary ammonium salt is coated on the surface of transfer paper by size pressing on a paper mill so that the surface resistivity (JIS K 6911) of the paper is adjusted to 109 to 1011Ω (at a temperature of 20° C. and at a relative humidity of 65%). Further, in order to improve the sharpness the image area of copy, the transfer paper is calendered or otherwise processed produce surface asperities, thereby adjusting the smoothness of the paper (JIS P 8119) to 10 sec and more, preferably 20 sec and more. On the other hand, in order to prevent the ripple effect or the occurrence of post fuser curl, the water content of the final product right after the package is open is adjusted to be within the range from 4.0 to 6.5% of an appropriate value by a suitable method such as drying on a paper mill or during the calendering or shredding step. It should also be noted that in order to prevent the fogging of nonimage areas in the case where copy paper is used as a document, the whiteness of the transfer paper should preferably be adjusted to 70% and higher. To insure that neither absorption nor desorption of moisture will occur during storage, the transfer paper should be wrapped with moistureproof wrapping paper such as polyethylene laminated paper or with a film such as polypropylene film.

BRIEF DESCRIPTION OF THE DRAWINGS

FIGS. 6(*d*), 6(*e*) and 6(*f*) shows an embodiment of the invention representing making paper processes of a twin-wire type.

DETAIL DESCRIPTION OF THE PREFERRED EMBODIMENTS

Figure 1:
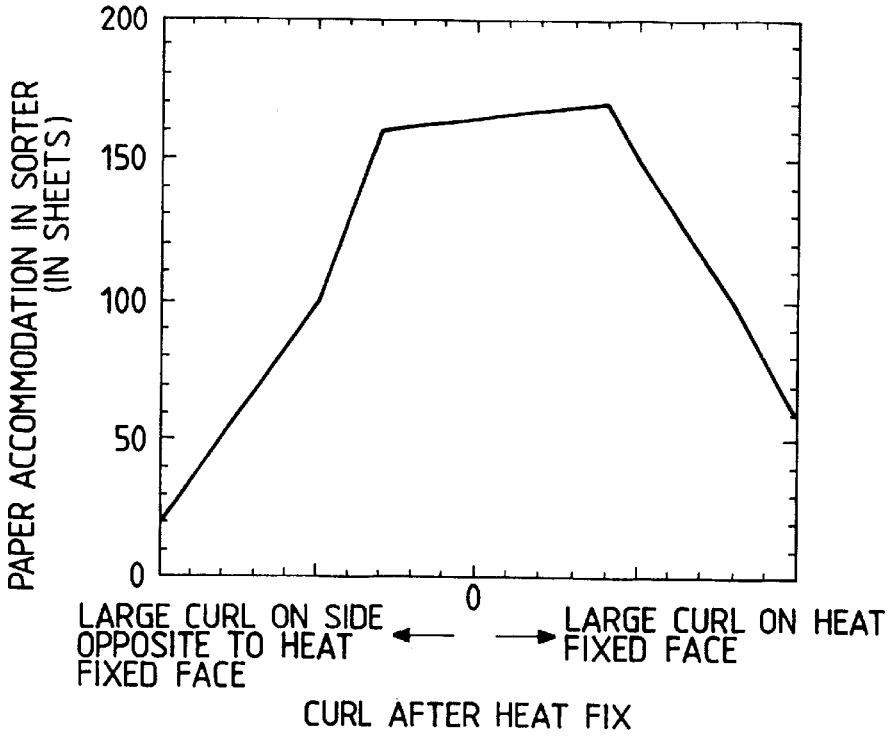
FIG. 1 is a graph showing the relationship between the degree of post fuser curl and the accommodation of paper in the sorter.
Figure 2:
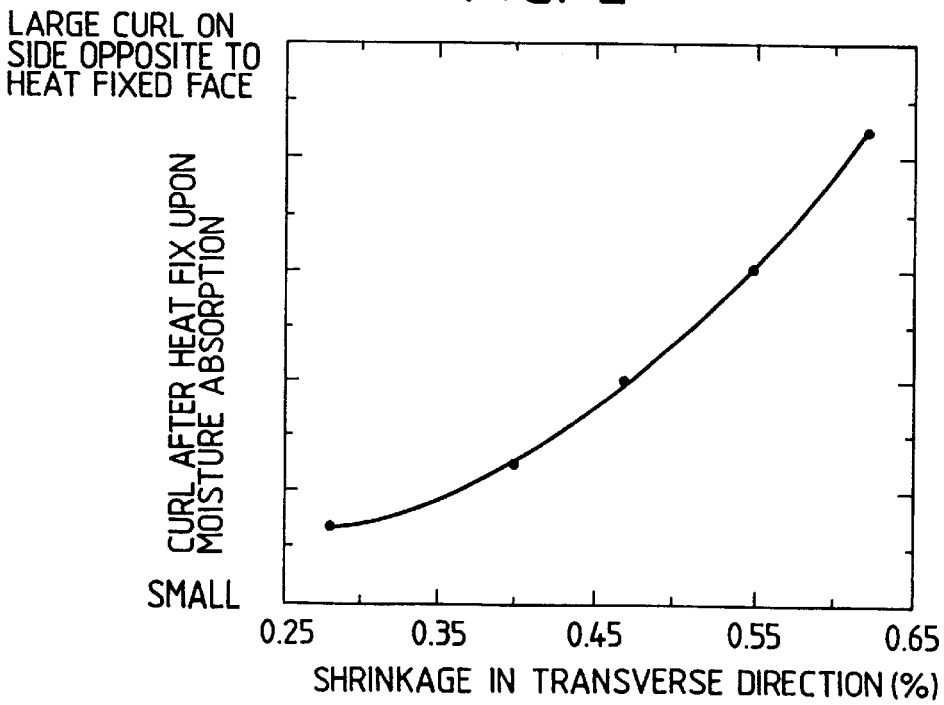
FIG. 2 is a graph showing the relationship between the post fuser curl upon moisture absorption and the degree of shrinkage in cross direction of paper that was prepared from pulp consisting of 70% virgin CP and 30% newspaper DIP and which had a basis weight of 66 g/m$^2$, a thickness of 100 $\mu$m and an ash content of 1.8%.
Figure 3:
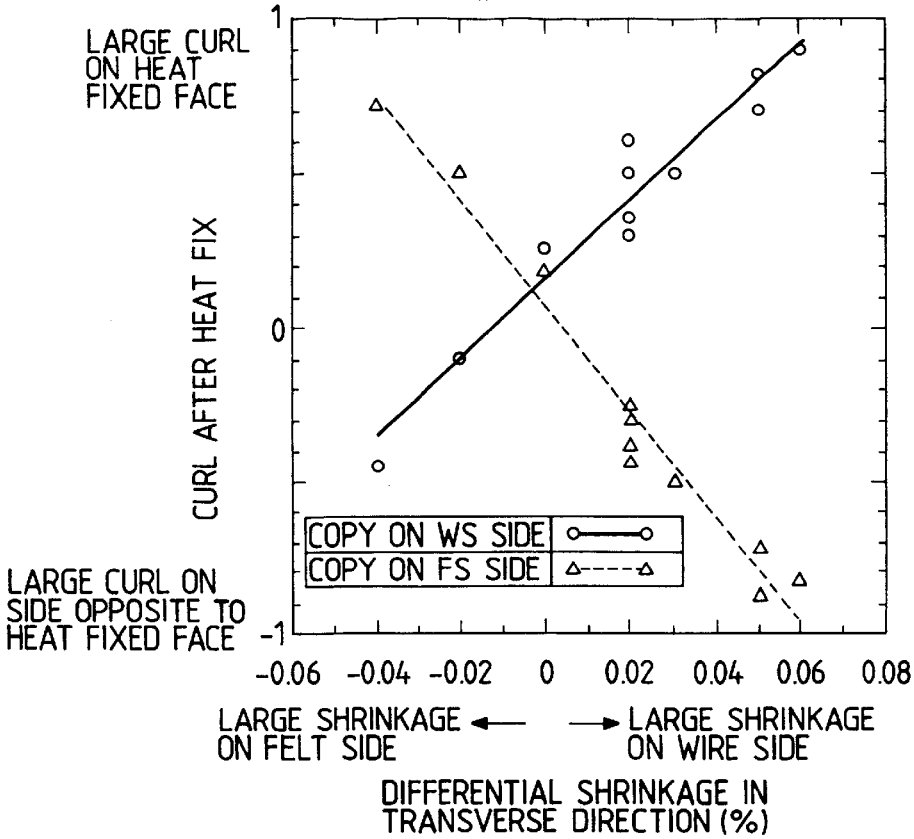
FIG. 3. is a graph showing the relationship between the post fuser curl and the differential shrinkage in cross direction of paper that was prepared from pulp solely composed of virgin CP and which had a basis weight of 64 g/m$^2$, a thickness of 93 $\mu$m and an ash content of 7.5%.
Figure 4:
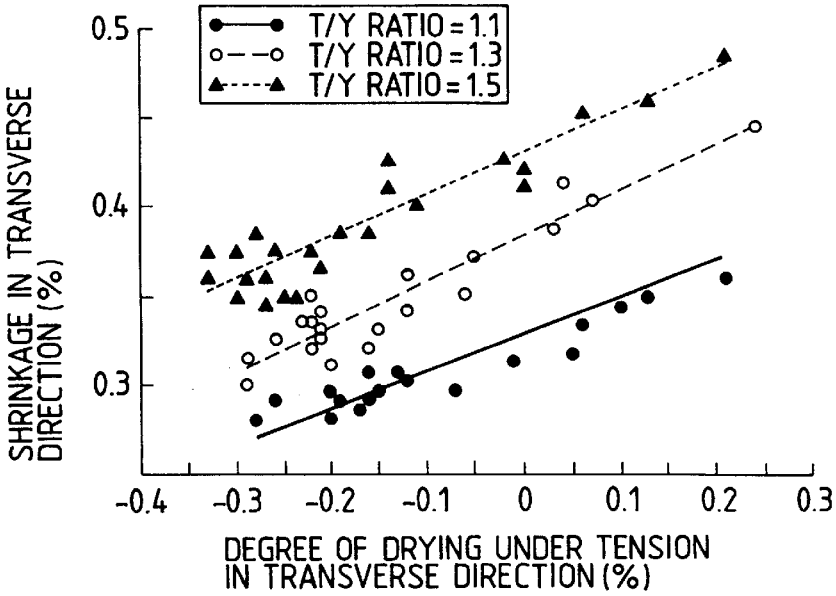
FIG. 4 is a graph showing the relationship between the shrinkage in cross direction and the degree of drying under tension of paper that was prepared from pulp consisting of 30% virgin CP and 70% woodfree wastepaper DIP and which had a basis weight of 67 g/m$^2$, a thickness of 98 $\mu$m and an ash content of 4.5%.
Figure 5:
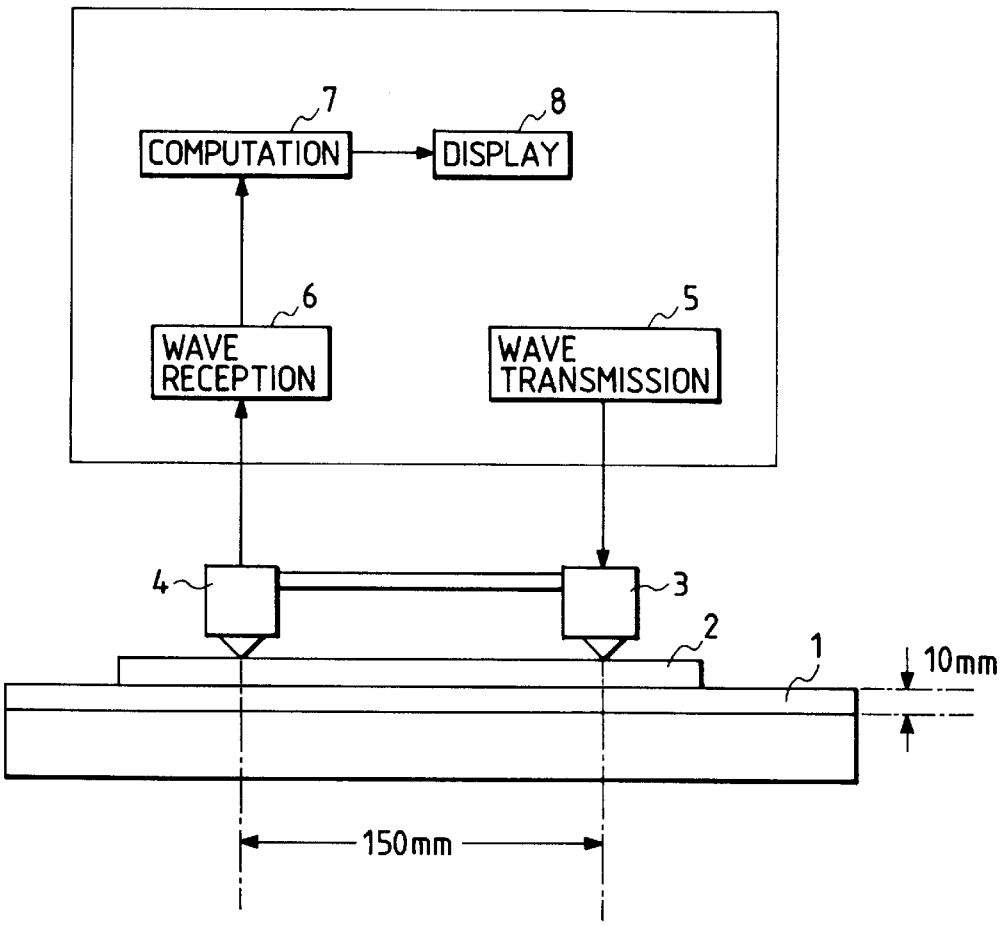
FIG. 5 is a block diagram showing a method of measuring the velocity of propagation of longitudinal waves of ultrasonic pulse.
Figure 6A:
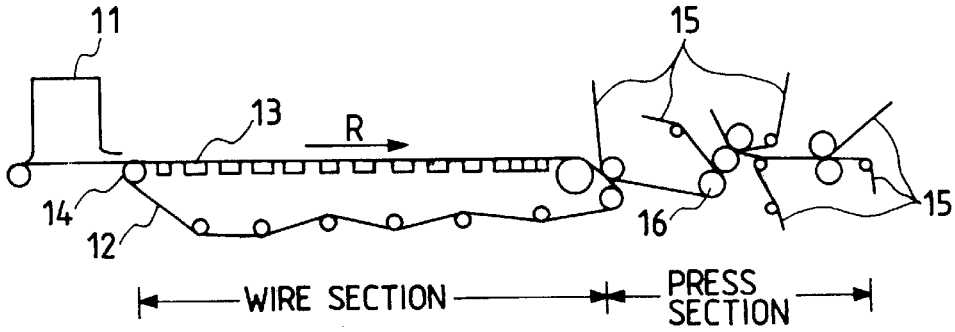
FIGS. 6(*a*), 6(*b*) and 6(*c*) shows a summarized making paper processes of a Fourdrinier machines.
Figure 6B:
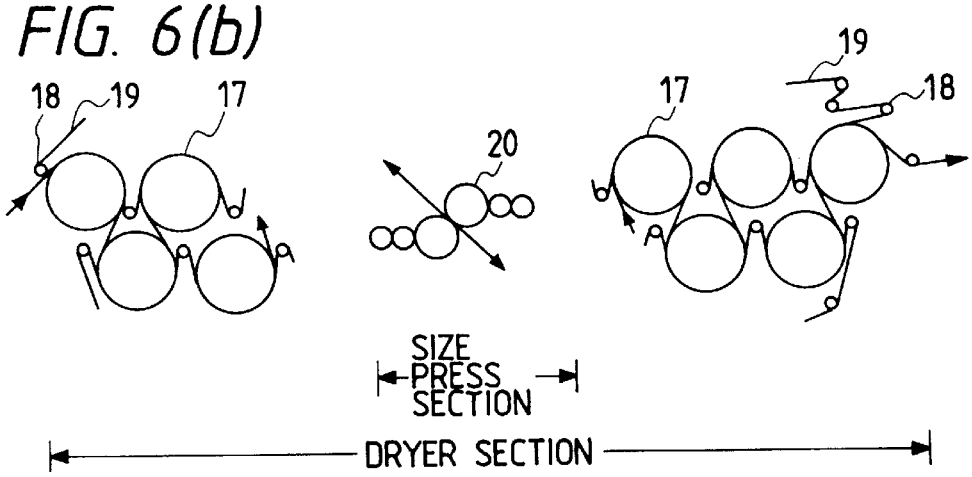
Figure 6C:
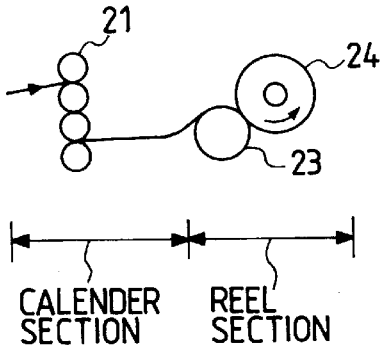
Figure 6D:
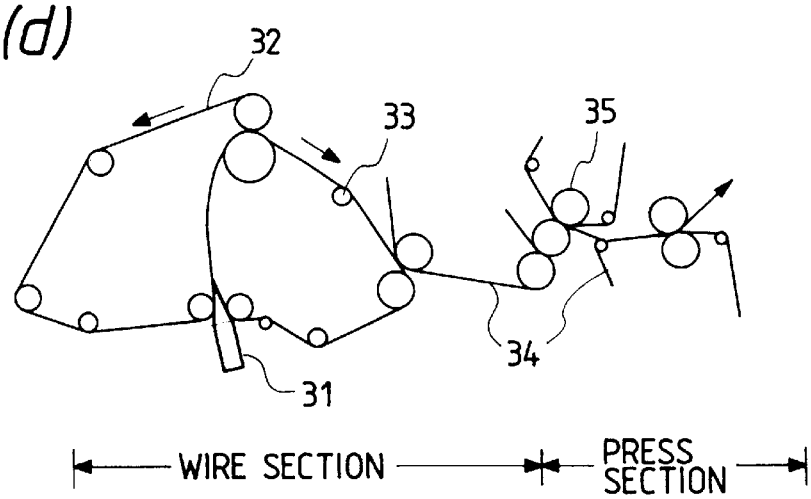
Figure 6E:
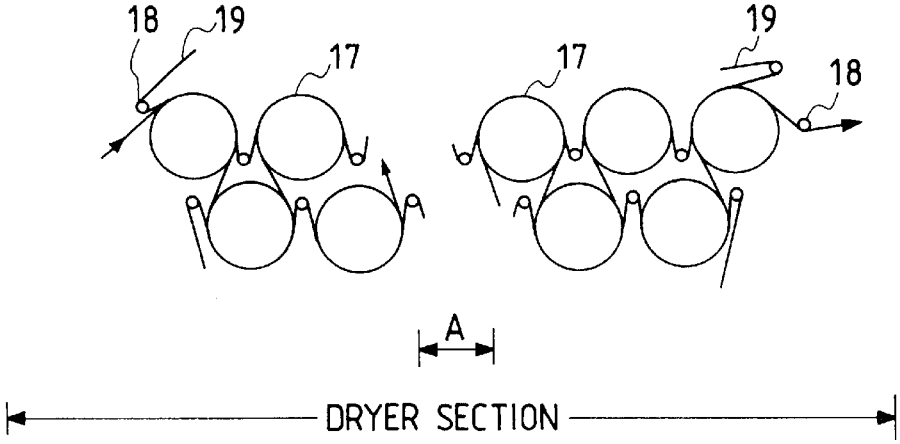
Figure 6F:
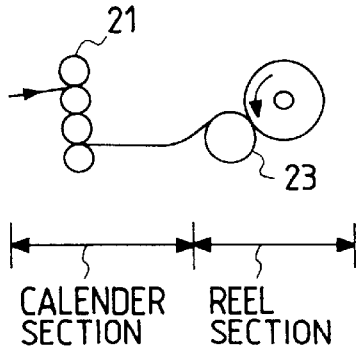
Figure 7B:
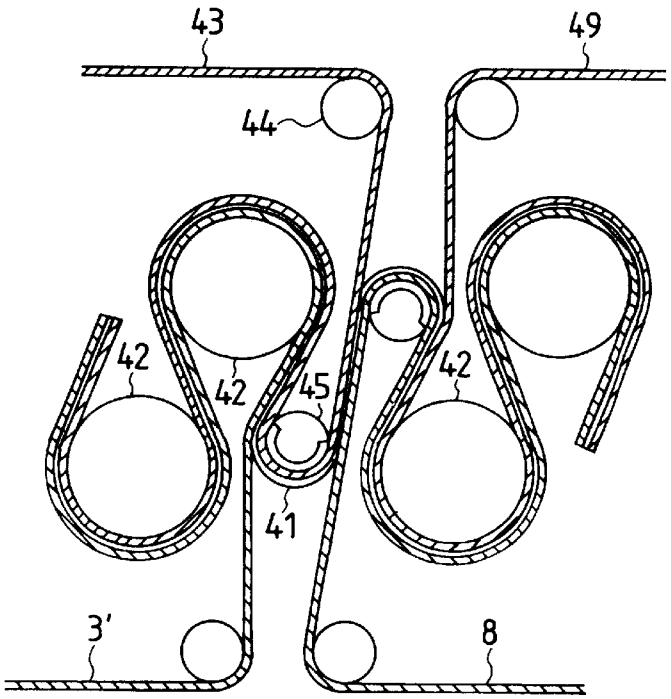
FIGS. 7(*a*) and 7(*b*) show an embodiment of the invention, representing a dryer section to realize a drying with an appropriate force of constraint.
Figure 7A:
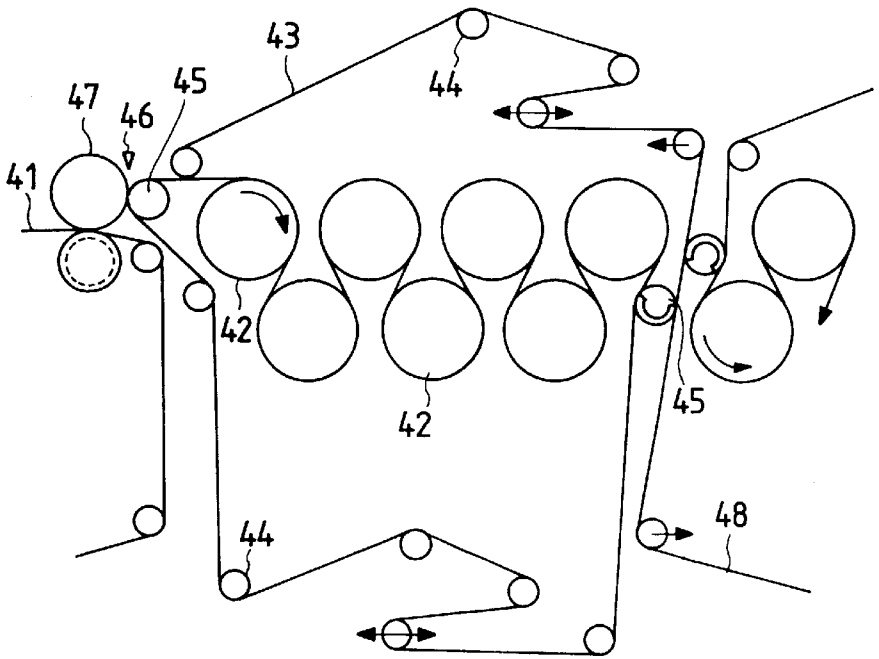

The following examples and comparative examples are provided for the purpose of further illustrating the present invention but are in no way to be taken as limiting.

EXAMPLE 1

As shown under "Example 1" in Table 1, the pulp material used consisted of 80% virgin CP (hardwood bleached kraft pulp) and 20% woodfree waste paper DIP.

The process conditions were so set that the longitudinal wave propagation velocity ratio (T/Y ratio) of ultrasonic wave would be 1.1 as measured with SST-210 (Sonic Sheet Tester-210 of Nomura Shoji Co., Ltd.) while the ash content would be 1.5%. As a sizing agent to be added, ASA was incorporated in an amount of 0.1% (on the basis of pulp weight). The stock thus prepared was subjected to paper-making on a Fourdrinier machine at a speed of 450 m/min and dehydration was conducted from one side of the machine, thereby forming a paper layer.

Furthermore, in order to impart adaptability for indirect electrophotography, starch and sodium chloride were applied with a size press to give respective deposits of 1 g/m$^2$ and 0.2 g/m$^2$; the applied coat was dried as a force of constraint was exerted in a direction crossing to the direction of paper path, whereby a sample of the transfer paper of the present invention was produced.

This transfer paper was measured for its shrinkage characteristics in the cross direction and the results were as follows: the shrinkage was 0.37%, the degree of drying under tension was 0.1%; and the difference in shrinkage between the two sideness of the paper was 0%. This difference in shrinkage between the two sideness of the paper was measured after separation of its two sideness by means of a sheet splitter (SHEET SPLITTER of Kumagai Riki Kogyo K.K.).

The adaptability of this transfer paper for copying in a humid environment was verified by the following procedure. The paper was conditioned with moisture by exposure to the environment 20° C., 65% r.h. until a complete equilibrium in water content was reached. Using a copier (Model FX 9300 of Fuji Xerox Co., Ltd.), both single-sided and two-sided prints were made and their resistance to post fuser curl and paper accommodation in the sorter were examined. The results are shown in Table 1.

As one can see from Table 1, the advantage of adjusting the T/Y ratio, the shrinkage of paper in its cross direction, the degree of drying under tension and the difference in shrinkage between two sideness of the paper to 1.1, 0.37%, 0.1% and 0.01%, respectively, was the production of transfer paper that experienced only a small amount of curl upon running after conditioning with high moisture content and which was also satisfactory in paper accommodation in the sorter.

EXAMPLE 2

As shown under "Example 2" in Table 1, the pulp material used consisted of 70% virgin CP (hardwood bleached kraft pulp) and 30% virgin MP. The process conditions were set so that the T/Y ratio would be 1.1 while the ash content would be 3.5%. As a sizing agent to be added, AKD was incorporated in an amount of 0.1% (on the basis of pulp weight). The stock thus prepared was subjected to paper-making on a Fourdrinier machine at a speed of 400 m/min and dehydration was conducted from one side of the machine, thereby forming a paper layer. Furthermore, in order to impart adaptability for indirect electrophotography, starch and sodium chloride were applied with a size press to give respective deposits of 1 g/m$^2$ and 0.2 g/m$^2$; the applied coat was dried as a force of constraint was exerted in a direction crossing to the direction of paper path, whereby another sample of transfer paper of the present invention was produced.

This transfer paper was measured for its shrinkage characteristics in the cross direction by means of an equal ratio exchange shrinkage meter and the results were as follows: the shrinkage was 0.31%; the degree of drying under tension was 0%; and the difference in shrinkage between the two sideness of the paper was −0.02%. This transfer paper was evaluated by the same method as used in Example 1 and the results are shown in Table 1.

As one can see from Table 1, the advantage of adjusting the T/Y ratio, the shrinkage of paper in its cross direction, the degree of drying under tension and the difference in shrinkage between two sideness of the paper to 1.1, 0.31%, 0% and −0.02%, respectively, was the production of transfer paper that experienced only a small amount of curl upon running after conditioning with high moisture content and which was also satisfactory in paper accommodation in the sorter.

EXAMPLE 3

As shown under "Example 3" in Table 1, the pulp material used consisted of 30% virgin CP (hardwood bleached kraft pulp) and 70% newspaper DIP. The process conditions were so set that the T/Y ratio would be 1.1 while the ash content would be 7.5%. A petroleum resin sizing agent was incorporated as a sizing agent to be added in an amount of 0.1% (on the basis of pulp weight). The stock thus prepared was subjected to papermaking on a Fourdrinier machine at a speed of 500 m/min and dehydration was conducted from one side of the machine; thereafter, two sides were joined together in such a way that the dehydrated side would face outward, thereby forming a paper layer. Furthermore, in order to impart adaptability for indirect electrophotography, starch and sodium chloride were applied with a size press to give respective deposits of 1 g/m$^2$ and 0.2 g/m$^2$; the applied coat was dried as a force of constraint was exerted in a direction crossing to the direction of paper path, whereby a third sample of the transfer paper of the present invention was produced.

This transfer paper was measured for its shrinkage characteristics in the cross direction by means of an equal ratio exchange shrinkage meter and the results were as follows: the shrinkage was 0.29%; the degree of drying under tension was −0.1%; and the difference in shrinkage between the two sideness of the paper was 0%. This transfer paper was evaluated by the same method as used in Example 1 and the results are shown in Table 1.

As one can see from Table 1, the advantage of adjusting the T/Y ratio, the shrinkage of paper in its cross direction, the degree of drying under tension and the difference in shrinkage between two sideness of the paper to 1.1, 0.29%, −0.1% and 0%, respectively, was the production of transfer paper that experienced only a small amount of curl upon running after conditioning with high moisture content and which was also satisfactory in paper accommodation in the sorter.

EXAMPLE 4

As shown under "Example 4" in Table 2, the pulp material used consisted of 30% virgin CP (hardwood bleached kraft pulp) and 70% newspaper DIP. The process conditions were so set that the T/Y ratio would be 1.3 while the ash content would be 2.0%. As a sizing agent to be added, ASA was incorporated in an amount of 0.1% (on the basis of pulp weight). The stock thus prepared was subjected to papermaking on a Fourdrinier machine at a speed of 600 m/min and dehydration was performed on both sides, one side at a time, thereby forming a paper layer. Furthermore, in order to impart adaptability for indirect electrophotography, starch and sodium chloride were applied with a size press to give respective deposits of 1 g/m$^2$ and 0.2 g/m$^2$; the applied coat was dried as a force of constraint was exerted in a direction crossing to the direction of paper path, whereby a fourth sample of the transfer paper of the present invention was produced.

This transfer paper was measured for its shrinkage characteristics in the cross direction by means of an equal ratio exchange shrinkage meter and the results were as follows: the shrinkage was 0.36%; the degree of drying under tension was 0%; and the difference in shrinkage between two sideness of the paper was 0.02%. This transfer paper was evaluated by the same method as used in Example 1 and the results are shown in Table 2.

As one can see from Table 2, the advantage of adjusting the T/Y ratio, the shrinkage of paper in its cross direction, the degree of drying under tension and the difference in shrinkage between two sideness of the paper to 1.3, 0.36%, 0% and 0.02%, respectively, was the production of transfer paper that experienced only a small amount of curl upon running after conditioning with high moisture content and which was also satisfactory in paper accommodation in the sorter.

EXAMPLE 5

As shown under "Example 5" in Table 2, the pulp material used was solely composed of woodfree waste paper DIP. The process conditions were so set that the T/Y ratio would be 1.3 while the ash content would be 8.0%. As a sizing agent to be added, AKD was incorporated in an amount of 0.1% (on the basis of pulp weight). The stock thus prepared was subjected to papermaking on a Fourdrinier machine at a speed of 500 m/min and dehydration was conducted from one side of the machine, thereby forming a paper layer. Furthermore, in order to impart adaptability for indirect electrophotography, starch and sodium chloride were applied with a size press to give respective deposits of 1 g/m$^2$ and 0.2 g/m$^2$; the applied coat was dried as a force of constraint was exerted in a direction perpendicular to the direction of paper path, whereby a fifth sample of the transfer paper of the present invention was produced.

This transfer paper was measured for its shrinkage characteristics in the cross direction by means of an equal ratio exchange shrinkage meter and the results were as follows: the shrinkage was 0.33%; the degree of drying under tension was −0.1%; and the difference in shrinkage between the two sideness of the paper was −0.01%. This transfer paper was evaluated by the same method as used in Example 1 and the results are shown in Table 2.

As one can see from Table 2, the advantage of adjusting the T/Y ratio, the shrinkage of paper in its cross direction, the degree of drying under tension and the difference in shrinkage between two sideness of the paper to 1.3, 0.33%, −0.1% and −0.01%, respectively, was the production of transfer paper that experienced only a small amount of curl upon running after conditioning with high moisture content and which was also satisfactory in paper accommodation in the sorter.

EXAMPLE 6

As shown under "Example 6" in Table 2, the pulp material used consisted of 30% virgin CP (hardwood bleached kraft pulp) and 70% newspaper DIP. The process conditions were so set that the T/Y ratio would be 1.3 while the ash content would be 4.0%. A petroleum resin sizing agent was incorporated as a sizing agent to be added in an amount of 0.1% (on the basis of pulp weight). The stock thus prepared was subjected to papermaking on a Fourdrinier machine at a speed of 650 m/min and dehydration was conducted from one side of the machine; thereafter, two sides were jointed together in such a way that the dehydrated side would face outward, thereby forming a paper layer. Furthermore, in order to impact adaptability for indirect electrophotography, starch and sodium chloride were applied with a size press to give respective deposits 1 g/m$^2$ and 0.2 g/m $^2$; the applied coat was dried as a force of constraint was exerted in a direction crossing to the direction of paper path, whereby a sixth sample of the transfer paper of the present invention was produced.

This transfer paper was measured for its shrinkage characteristics in the cross direction by means of an equal ratio exchange shrinkage meter and the results were as follows: the shrinkage was 0.29%; the degree of drying under tension was −0.3%; and the difference in shrinkage between the two sideness of the paper was 0%. This transfer paper was evaluated by the same method as used in Example 1 and the results are shown in Table 2.

As one can see from Table 2, the advantage of adjusting the T/Y ratio, the shrinkage of paper in its cross direction, the degree of drying under tension and the difference in shrinkage between two sideness of the paper to 1.3, 0.29%, −0.3% and 0%, respectively, was the production of transfer paper that experienced only a small amount of curl upon running after conditioning with high moisture content and which was also satisfactory in paper accommodation in the sorter.

EXAMPLE 7

As shown under "Example 7" in Table 3, the pulp material used consisted of 40% virgin CP (hardwood bleached kraft pulp) and 60% newspaper DIP. The process conditions were so set that the T/Y ratio would be 1.5 while the ash content would be 7.0%. As a sizing agent to be added, AKD was incorporated in an amount of 0.1% (on the basis of pulp weight). The stock thus prepared was subjected to papermaking on a twin wire machine at a speed of 750 m/min and dehydration was conducted from both sides of the machine, thereby forming a paper layer. Furthermore, in order to impart adaptability for indirect electrophotography, starch and sodium chloride were applied with a size press to give respective deposits of 1 g/m$^2$ and 0.2 g/m$^2$; the applied coat was dried as a force of constraint was exerted in a direction crossing to the direction of paper path, whereby a seventh sample of the transfer paper of the present invention was produced.

This transfer paper was measured for its shrinkage characteristics in the cross direction by means of an equal ratio exchange meter and the results were as follows: the shrinkage was 0.45%; the degree of drying under tension was 0.1%; and the difference in shrinkage between the two sideness of the paper was 0.02%. This transfer paper was evaluated by the same method as used in Example 1 and the results are shown in Table 3.

As one can see from Table 3, the advantage of adjusting the T/Y ratio, the shrinkage of paper in its cross direction, the degree of drying under tension and the difference in shrinkage between two sideness of the paper to 1.5, 0.45%, 0.1% and 0.02%, respectively, was the production of transfer paper that experienced only a small amount of curl upon running after conditioning with high moisture content and which was also satisfactory in paper accommodation in the sorter.

EXAMPLE 8

As shown under "Example 8" in Table 3, the pulp material used was solely composed of newspaper DIP. The process conditions were so set that the T/Y ratio would be 1.5 while the ash content would be 3.0%. A petroleum resin sizing agent was incorporated as a sizing agent to be added in an amount of 0.1% (on the basis of pulp weight). The stock thus prepared was subjected to papermaking on a Fourdrinier machine at a speed of 700 m/min and dehydration was conducted from one side of the machine, thereby forming a paper layer. Furthermore, in order to impart adaptability for indirect electrophotography, starch and sodium chloride were applied with a size press to give respective deposits of 1 g/m$^2$ and 0.2 g/m$^2$; the applied coat was dried as a force of constraint was exerted in a direction crossing to the direction of paper path, whereby an eighth sample of the transfer paper of the present invention was produced.

This transfer paper was measured for its shrinkage characteristics in the cross direction by means of an equal ratio exchange shrinkage meter and the results were as follows: the shrinkage was 0.39%; the degree of drying under tension was −0.1%; and the difference in shrinkage between the two sideness of the paper was 0.01%. This transfer paper was evaluated by the same method as used in Example 1 and the results are shown in Table 3.

As one can see from Table 3, the advantage of adjusting the T/Y ratio, the shrinkage of paper in its cross direction, the degree of drying under tension and the difference in shrinkage between two sideness of the paper to 1.5, 0.39%, −0.1% and 0.01%, respectively, was the production of transfer paper that experienced only a small amount of curl upon running after conditioning with high moisture content and which was also satisfactory in paper accommodation in the sorter.

EXAMPLE 9

As shown under "Example 9" in Table 3, the pulp material used was solely composed of virgin CP (hardwood bleached kraft pulp). The process conditions were so set that the T/Y ratio would be 1.5 while the ash content would be 5.0%. As a sizing agent to be added, ASA was incorporated in an amount of 0.1% (on the basis of pulp weight). The stock thus prepared was subjected to papermaking on a Fourdrinier machine at a speed of 900 m/min and dehydration was conducted from one side of the machine; thereafter, two sides were joined together in such a way that the dehydrated side would face outward, thereby forming a paper layer. Furthermore, in order to impart adaptability for indirect electrophotography, starch and sodium chloride were applied with a size press to give respective deposits of 1 g/m$^2$ and 0.2 g/m$^2$; the applied coat was dried as a force of constraint was exerted in a direction crossing to the direction of paper path, whereby a ninth sample of the transfer paper of the present invention was produced.

This transfer paper was measured for its shrinkage characteristics in the cross direction by means of an equal ratio exchange shrinkage meter and the results were as follows: the shrinkage was 0.34%; the degree of drying under tension was −0.2%; and the difference in shrinkage between the two sideness of the paper was 0%. This transfer paper was evaluated by the same method as used in Example 1 and the results are shown in Table 3.

As one can see from Table 3, the advantage of adjusting the T/Y ratio, the shrinkage of paper in its cross direction, the degree of drying under tension and the difference in shrinkage between two sideness of the paper to 1.5, 0.34%, −0.2% and 0%, respectively, was the production of transfer paper that experienced only a small amount of curl upon running after conditioning with high moisture content and which was also satisfactory in paper accommodation in the sorter.

Comparative Example 1

The pulp material used in this comparative example 1 consisted of 40% virgin CP (hardwood bleached kraft pulp)

and 60% newspaper DIP. The process conditions were so set that the T/Y ratio would be 1.4 while the ash content would be 2.0%. As a sizing agent to be added, ASA was incorporated in an amount of 0.1% (on the basis of pulp weight). The stock thus prepared was subjected to papermaking on a Fourdrinier machine at a speed of 550 m/min and dehydration was conducted from one side of the machine, thereby forming a paper layer. Furthermore, in order to impart adaptability for indirect electrophotography, starch and sodium chloride were applied with a size press to give respective deposits of 1 g/m$^2$ and 0.2 g/m$^2$; the applied coat was dried as a force of constraint was exerted in a direction crossing to the direction of paper path, whereby a comparative sample of transfer paper was produced.

The characteristics of this transfer paper are shown in Table 4. In addition, this transfer paper was tested by the same method as in Example to check for its resistance to post fuser curl and the ease of paper accommodation in the sorter. The results are summarized in Table 4.

Comparative Example 2

The pulp material used in this comparative example 2 was solely composed of virgin CP (hardwood bleached kraft pulp). The process conditions were so set that the T/Y ratio would be 1.6 whereas the ash content would be 4.0%. As a sizing agent to be added, AKD was incorporated in an amount of 0.1% (on the basis of pulp weight). The stock thus prepared was subjected to papermaking on a Fourdrinier machine at a speed of 850 m/min and dehydration was conducted from one side of the machine, thereby forming a paper layer. Furthermore, in order to impart adaptability for indirect electrophotography, starch and sodium chloride were applied with a size press to give respective deposits of 1 g/m$^2$ and 0.2 g/m$^2$; the applied coat was dried as a force of constraint was exerted in a direction crossing to the direction of paper path, whereby another comparative sample of transfer paper was produced.

The characteristics of this transfer paper are shown in Table 4. In addition, this transfer paper was tested by the same method as in Example 1 to check for its resistance to post fuser curl and the ease of paper accommodation in the sorter. The results are summarized in Table 4.

Comparative Example 3

The pulp material used in this comparative example 3 consisted of 30% virgin CP (hardwood bleached kraft pulp) and 70% newspaper DIP. The process conditions were so set that the T/Y ratio would be 1.1 whereas the ash content would be 6.5%. A petroleum resin sizing agent was incorporated as a sizing agent to be added in an amount of 0.1% (on the basis of pulp weight). The stock thus prepared was subjected to papermaking on a Fourdrinier machine at a speed of 400 m/min and dehydration was conducted from one side of the machine, thereby forming a paper layer. Thereafter, two sides were joined together in such a way that the dehydrated side would face outward, whereby a paper layer was formed. Furthermore, in order to impart adaptability for indirect electrophotography, starch and sodium chloride were applied with a size press to give respective deposits of 1 g/m$^2$ and 0.2 g/m$^2$; the applied coat was dried as a force of constraint was exerted in a direction crossing to the direction of paper path, whereby a third comparative sample of transfer paper was produced.

The characteristics of this transfer paper are shown in Table 4. In addition, this transfer paper was tested by the same method as in Example 1 to check for its resistance to post fuser curl and the ease of paper accommodation in the sorter. The results are summarized in Table 4.

Comparative Example 4

The pulp material used in this comparative example 4 consisted of 10% woodfree waste paper DIP and 90% newspaper DIP. The process conditions were so set that the T/Y ratio would be 1.3 whereas the ash content would be 8.0%. A petroleum resin sizing agent was incorporated as a sizing agent to be added in an amount of 0.1% (on the basis of pulp weight). The stock thus prepared was subjected to papermaking on a Fourdrinier machine at a speed of 550 m/min and dehydration was conducted from one side of the machine, thereby forming a paper layer. Furthermore, in order to impart adaptability for indirect electrophotography, starch and sodium chloride were applied with a size press to give respective deposits of 1 g/m$^2$ and 0.2 g/m$^2$; the applied coat was dried as a force of constraint was exerted in a direction crossing to the direction of paper path, whereby a fourth comparative sample of transfer paper was produced.

The characteristics of this transfer paper are shown in Table 5. In addition, this transfer paper was tested by the same method as in Example 1 to check for its resistance to post fuser curl and the ease of paper accommodation in the sorter. The results are summarized in Table 5.

Comparative Example 5

The pulp material used in this comparative example 5 was solely composed of newspaper DIP. The process conditions were so set that the T/Y ratio would be 1.7 whereas the ash content would be 5.0%. AKD was incorporated as a sizing agent to be added in an amount of 0.1% (on the basis of pulp weight). The stock thus prepared was subjected to papermaking on a Fourdrinier machine at a speed of 1050 m/min and dehydration was conducted from one side of the machine, thereby forming a paper layer. Furthermore, in order to impart adaptability for indirect electrophotography, starch and sodium chloride were applied with a size press to give respective deposits of 1 g/m$^2$ and 0.2 g/m$^2$; the applied coat was dried as a force of constraint was exerted in a direction crossing to the direction of paper path, whereby a fifth comparative sample of transfer paper was produced.

The characteristics of this transfer paper are shown in Table 5. In addition, this transfer was tested by the same method as in Example 1 to check for its resistance to post fuser curl and the ease of paper accommodation in the sorter. The results are summarized in Table 5.

Comparative Example 6

The pulp material used in this comparative example 6 consisted of 75% virgin CP (hardwood bleached kraft pulp) and 25% virgin MP. The process conditions were so set that the T/Y ratio would be 1.6 whereas the ash content would be 3.5%. ASA was incorporated as a sizing agent to be added in an amount of 0.1% (on the basis of pulp weight). The stock thus prepared was subjected to papermaking on a Fourdrinier machine at a speed of 750 m/min and dehydration was conducted from one side of the machine, thereby forming a paper layer. Furthermore, in order to impart adaptability for indirect electrophotography, starch and sodium chloride were applied with a size press to give respective deposits of 1 g/m$^2$ and 0.2 g/m$^2$; the applied coat was dried as a force of constraint was exerted in a direction crossing to the direction of paper path, whereby a sixth comparative sample of transfer paper was produced.

The characteristics of this transfer paper are shown in Table 5. In addition, this transfer paper was tested by the same method as in Example 1 to check for its resistance to post fuser curl and the ease of paper accommodation in the sorter. The results are summarized in Table 5.

TABLE 1

| Example | 1 | 2 | 3 |
|---|---|---|---|
| Pulp formula (%) | virgin CP 80<br>woodfree wastepaper DIP 20 | virgin CP 70<br>virgin MP 30<br>DIP (MP) 56 | virgin CP 30<br>newspaper DIP (CP) 14<br>newspaper |
| Basis weight ($g/m^2$) | 65 | 66 | 67 |
| Thickness ($\mu m$) | 86 | 94 | 100 |
| Density ($g/cm^3$) | 0.76 | 0.70 | 0.67 |
| Shrinkage in cross direction (%) | 0.37 | 0.31 | 0.29 |
| Differential shrinkage in cross direction (%) | 0 | −0.02 | 0 |
| Longitudinal wave propagation velocity ratio | 1.1 | 1.1 | 1.1 |
| Degree of drying under tension (%) | 0.1 | 0 | −0.1 |
| Equilibrium moisture*1) (%) | 7.8 | 8.2 | 8.4 |
| Ash content (%) | 1.5 | 3.5 | 7.5 |
| Post fuser curl *2) (FS/wS) | ⊙/⊙ | ○/⊙ | ⊙/⊙ |
| Accommodation in sorter*3) | ⊙ | ⊙ | ⊙ |

*1)Equilibrium moisture in the environment 20° C., 65% r.h.
*2)Run after complete humidification in the environment 20° C., 65% r.h. ⊙, very small curl; ○,small curl; Δlarge curl; x, very large curl
*3)Run after complete humidification in the environment 20° C., 65% r.h. ⊙, 150 or more sheets could be accommodated; ○, 100 to 149 sheets could be accommodated; Δ, 50 to 99 sheets could be accommodated; x, less than 50 sheets could be accommodated.

TABLE 2

| Example | 4 | 5 | 6 |
|---|---|---|---|
| Pulp formula (%) | virgin CP 30<br>newspaper DIP (CP) 14<br>DIP (MP) 56 | woodfreed wastepaper DIP 100<br>DIP (CP) 14 | woodfreed wastepaper DIP 30<br>newspaper<br>newspaper DIP (MP) 56 |
| Basis weight ($g/m^2$) | 68 | 66 | 68 |
| Thickness ($\mu m$) | 98 | 94 | 100 |
| Density ($g/cm^3$) | 0.69 | 0.70 | 0.68 |
| Shrinkage in cross direction (%) | 0.36 | 0.33 | 0.29 |
| Differential shrinkage in cross direction (%) | 0.02 | −0.01 | 0 |
| Longitudinal wave propagation velocity ratio | 1.3 | 1.3 | 1.3 |
| Degree of drying under tension (%) | 0 | −0.1 | −0.3 |
| Equilibrium moisture*1) (%) | 8.6 | 7.5 | 8.2 |
| Ash content (%) | 2.0 | 8.0 | 4.0 |
| Post fuser curl *2) (FS/wS) | ⊙/○ | ⊙/⊙ | ⊙/⊙ |

TABLE 2-continued

| Example | 4 | 5 | 6 |
|---|---|---|---|
| Accommodation in sorter*3) | ⊙ | ⊙ | ⊙ |

For *1, *2 and *3, see the notes to Table 1.

TABLE 3

| Example | 7 | 8 | 9 |
|---|---|---|---|
| Pulp formula (%) | virgin CP 30 | newspaper DIP (CP) 20<br>newspaper DIP (MP) 80 | virgin CP 40<br>newspaper DIP (CP) 28<br>newspaper |
| Basis weight ($g/m^2$) | 64 | 70 | 65 |
| Thickness ($\mu m$) | 89 | 108 | 98 |
| Density ($g/cm^3$) | 0.72 | 0.65 | 0.66 |
| Shrinkage in cross direction (%) | 0.45 | 0.39 | 0.35 |
| Differential shrinkage in cross direction (%) | 0 | 0.01 | 0.01 |
| Longitudinal wave propagation velocity ratio | 1.5 | 1.5 | 1.5 |
| Degree of drying under tension (%) | 0.1 | −0.1 | −0.2 |
| Equilibrium moisture*1) (%) | 7.6 | 9.5 | 8.0 |
| Ash content (%) | 7.0 | 8.0 | 5.0 |
| Post fuser curl *2) (FS/wS) | ⊙/⊙ | ⊙/⊙ | ⊙/⊙ |
| Accommodation in sorter*3) | ⊙ | ⊙ | ⊙ |

For *1, *2 and *3, see the notes to Table 1.

TABLE 4

| Comparative Example | 1 | 2 | 3 |
|---|---|---|---|
| Pulp formula (%) | virgin CP 40<br>newspaper DIP (CP) 28<br>newspaper DIP (MP) 32 | virgin CP 100 | virgin CP 30<br>newspaper DIP (CP) 14<br>newspaper DIP (MP) 56 |
| Basis weight ($g/m^2$) | 65 | 64 | 67 |
| Thickness ($\mu m$) | 92 | 85 | 102 |
| Density ($g/cm^2$) | 0.71 | 0.75 | 0.66 |
| Shrinkage in cross direction (%) | 0.43 | 0.49 | 0.52 |
| Differential shrinkage in cross direction (%) | 0.05 | 0.02 | 0 |
| Longitudinal wave propagation velocity ratio | 1.4 | 1.6 | 1.1 |
| Degree of drying under tension (%) | 0 | −0.1 | 0.15 |
| Equilibrium moisture*1) (%) | 8.4 | 7.7 | 8.5 |
| Ash content (%) | 2.0 | 4.0 | 6.5 |
| Post fuser curl *2) (FS/WS) | Δ/x | ○/Δ | Δ/Δ |
| Accommodation in sorter*3) | x | Δ | Δ |

*1)Equilibrium moisture in the environment 20° C., 65% r.h.

TABLE 4-continued

| Comparative Example | 1 | 2 | 3 |
|---|---|---|---|

*2)Run after complete humidification in the environment 20° C., 65% r.h. ⊙, very small curl; ○, small curl; Δ, large curl; x, very large curl
*3)Run after complete humidification in the environment 20° C., 65% r.h. ⊙, 150 or more sheets could be accommodated; ○, 100 to 149 sheets could be accommodated; Δ, 50 to 99 sheets could be accommodated; x, less than 50 sheets could be accommodated.

TABLE 5

| Comparative Example | 1 | 2 | 3 |
|---|---|---|---|
| Pulp formula (%) | woodfree wastepaper DIP 10 newspaper DIP (CP) 18 newspaper DIP (MP) 72 | newspaper DIP (CP) 20 newspaper DIP (MP) 80 | virgin CP 75 virgin MP 25 |
| Basis weight ($g/m^2$) | 67 | 68 | 66 |
| Thickness ($\mu m$) | 100 | 105 | 94 |
| Density ($g/cm^3$) | 0.67 | 0.65 | 0.70 |
| Shrinkage in cross direction (%) | 0.59 | 0.55 | 0.65 |
| Differential shrinkage in cross direction (%) | 0.04 | 0.08 | −0.02 |
| Longitudinal wave propagation velocity ratio | 1.3 | 1.7 | 1.6 |
| Degree of drying under tension (%) | 0.18 | −0.2 | 0.13 |
| Equilibrium moisture*1) (%) | 8.7 | 8.9 | 8.1 |
| Ash content (%) | 8.0 | 5.0 | 3.5 |
| Post fuser curl *2) (FS/WS) | Δ/x | Δ/x | x/x |
| Accommodation in sorter*3) | x | x | x |

For *1, *2 and *3, see the notes to Table 4.

The transfer paper of the present invention is such that longitudinal waves of ultrasonic pulse will propagate at a velocity ratio in the range from 1.1 to 1.5 and that it has been dried under tension to a degree of 0.10% and below. Furthermore, it is produced in such a way that a paper layer is formed on a paper mill by performing dehydration from both its two sideness. As a result, the transfer paper of the invention will shrink by no more than 0.45% in cross direction and has a shrinkage difference of a range from 0.02 to −0.02% between its two sideness in cross direction. Hence, the transfer paper has higher resistance to post fuser curl than the prior art versions irrespective of which side of the paper is subjected to copying. In particular, the paper has high resistance to curl even if it has absorbed moisture and it will experience only a small difference in curl between the two sideness. Therefore, the transfer paper of the invention is superior to the prior art versions in that it permits more efficient paper accommodation in the sorter and the catching tray and that problems such as a paper jam during the making of two-sided copies are less likely to occur.

What is claimed is:

1. Electrophotographic transfer paper having a shrinkage of no more than 0.45% in a direction crossing a flow direction in a paper making process and a two sideness shrinkage difference in the crossing direction ranging from 0.02 to −0.02%.

2. Electrophotographic transfer paper according to claim 1 which has a degree of drying under tension of 0.10% and below.

3. Electrophotographic transfer paper manufactured by a process including the steps of feeding pulp suspension liquid onto a moving wire, controlling a feeding rate of the pulp suspension liquid and a rate of movement of the moving wire to a desired velocity ratio, pressing the paper layer to remove water therefrom, and applying heat to dry the paper layer under constraint in a direction crossing a flow direction in the paper making process, the electrophotographic transfer paper having a shrinkage of no more than 0.45% in the crossing direction and a two sideness shrinkage difference in the crossing direction ranging from 0.02 to −0.02%.

4. Electrophotographic transfer paper according to claim 3 which has a degree of drying under tension of 0.10% and below.

* * * * *

UNITED STATES PATENT AND TRADEMARK OFFICE

CERTIFICATE OF CORRECTION

PATENT NO. : 6,221,210 B1
DATED : April 24, 2001
INVENTOR(S) : Tsutomu Kurihara et al.

It is certified that error appears in the above-identified patent and that said Letters Patent is hereby corrected as shown below:

Title page,
Item [57] ABSTRACT, line 1, after "paper", insert -- for use --.
Item [57] ABSTRACT, line 5, after "ranging", insert -- from --.

Signed and Sealed this

Second Day of April, 2002

*Attest:*

*Attesting Officer*

JAMES E. ROGAN
*Director of the United States Patent and Trademark Office*